US005848773A

United States Patent [19]

Bourassa

[11] Patent Number: 5,848,773

[45] Date of Patent: Dec. 15, 1998

[54] MOUSE PAD SUPPORT PEDESTAL

[76] Inventor: David O. Bourassa, 8 Grant Ct., P.O. Box 71, Queensville, Ontario, Canada, L0G 1R0

[21] Appl. No.: 842,909

[22] Filed: Apr. 17, 1997

[51] Int. Cl.[6] ..... A47C 7/62

[52] U.S. Cl. ..... 248/298.1; 248/223.41; 248/918; 297/135; 297/188.14

[58] Field of Search ..... 248/298.1, 918, 248/118, 118.1, 118.5, 228.3, 231.41, 223.41, 225.11; 108/143; 297/135, 188.14, 188.18

[56] References Cited

U.S. PATENT DOCUMENTS

| | | | |
|---|---|---|---|
| 2,477,898 | 8/1949 | Rehman et al. | 248/118 |
| 2,713,530 | 7/1955 | Chisolm | 108/143 X |
| 4,576,351 | 3/1986 | Brink | 248/118 |
| 4,822,103 | 4/1989 | Stenvall | 248/118 X |
| 5,154,385 | 10/1992 | Lindberg et al. | 248/225.11 |
| 5,320,313 | 6/1994 | Crowe | 248/918 X |
| 5,351,897 | 10/1994 | Martin | 248/918 X |
| 5,439,268 | 8/1995 | Dozsa-Farkas | 248/118.5 X |
| 5,606,917 | 3/1997 | Cauffiel | 297/135 X |

*Primary Examiner*—Derek J. Berger

[57] ABSTRACT

A new mouse pad support pedestal for supporting a mouse pad on an arm of a chair. The inventive device includes a clamp device having a stationary clamping portion and a moveable clamping portion for attaching the apparatus to an arm of a chair, a support pedestal adapted to retain a mouse pad thereon, with the support pedestal being attached to the stationary clamping portion in a manner permitting adjustment of the support pedestal along the stationary clamping portion.

9 Claims, 3 Drawing Sheets

MOUSE PAD SUPPORT PEDESTAL

BACKGROUND OF THE INVENTION

1. Field of the Invention

The present invention relates to support apparatus and more particularly pertains to a new mouse pad support pedestal for supporting a mouse pad on an arm of a chair.

2. Description of the Prior Art

The use of support apparatus for various components is known in the prior art. More specifically, support apparatus heretofore devised and utilized are known to consist basically of familiar, expected and obvious structural configurations, notwithstanding the myriad of designs encompassed by the crowded prior art which have been developed for the fulfillment of countless objectives and requirements.

Known prior art support apparatus include U.S. Pat. No. 5,311,210; U.S. Pat. No. 5,169,210; U.S. Pat. Des. 359,038; U.S. Pat. No. 4,427,232; U.S. Pat. No. 5,398,901 and U.S. Pat. No. 5,054,011.

While these devices fulfill their respective, particular objectives and requirements, the aforementioned patents do not disclose a new mouse pad support pedestal. The inventive device includes a clamp device having a stationary clamping portion and a moveable clamping portion for attaching the apparatus to an arm of a chair, and a support pedestal adapted to retain a mouse pad thereon, with the support pedestal being attached to the stationary clamping portion in a manner permitting adjustment of the support pedestal along the stationary clamping portion.

In these respects, the mouse pad support pedestal according to the present invention substantially departs from the conventional concepts and designs of the prior art, and in so doing provides an apparatus primarily developed for the purpose of supporting a mouse pad on an arm of a chair.

SUMMARY OF THE INVENTION

In view of the foregoing disadvantages inherent in the known types of support apparatus now present in the prior art, the present invention provides a new mouse pad support pedestal construction wherein the same can be utilized for supporting a mouse pad on an arm of a chair.

The general purpose of the present invention, which will be described subsequently in greater detail, is to provide a new mouse pad support pedestal apparatus and method which has many of the advantages of the support apparatus mentioned heretofore and many novel features that result in a new mouse pad support pedestal which is not anticipated, rendered obvious, suggested, or even implied by any of the prior art support apparatus, either alone or in any combination thereof.

To attain this, the present invention generally comprises a clamp device having a stationary clamping portion and a moveable clamping portion for attaching the apparatus to an arm of a chair, a support pedestal adapted to retain a mouse pad thereon, with the support pedestal being attached to the stationary clamping portion in a manner permitting adjustment of the support pedestal along the stationary clamping portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mouse pad support pedestal apparatus and method which has many of the advantages of the support apparatus mentioned heretofore and many novel features that result in a new mouse pad support pedestal which is not anticipated, rendered obvious, suggested, or even implied by any of the prior art support apparatus, either alone or in any combination thereof.

It is another object of the present invention to provide a new mouse pad support pedestal which may be easily and efficiently manufactured and marketed.

It is a further object of the present invention to provide a new mouse pad support pedestal which is of a durable and reliable construction.

An even further object of the present invention is to provide a new mouse pad support pedestal which is susceptible of a low cost of manufacture with regard to both materials and labor, and which accordingly is then susceptible of low prices of sale to the consuming public, thereby making such mouse pad support pedestal economically available to the buying public.

Still yet another object of the present invention is to provide a new mouse pad support pedestal which provides in the apparatuses and methods of the prior art some of the advantages thereof, while simultaneously overcoming some of the disadvantages normally associated therewith.

Still another object of the present invention is to provide a new mouse pad support pedestal for supporting a mouse pad on an arm of a chair.

Yet another object of the present invention is to provide a new mouse pad support pedestal which includes a clamp device having a stationary clamping portion and a moveable clamping portion for attaching the apparatus to an arm of a chair, a support pedestal adapted to retain a mouse pad thereon, with the support pedestal being attached to the stationary clamping portion in a manner permitting adjustment of the support pedestal along the stationary clamping portion.

Still yet another object of the present invention is to provide a new mouse pad support pedestal that reduces arm and back strain by eliminating reaching and other awkward movements while using a computer mouse.

Even still another object of the present invention is to provide a new mouse pad support pedestal that increases worker productivity and saves time, since a worker is more comfortable and works more efficiently.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
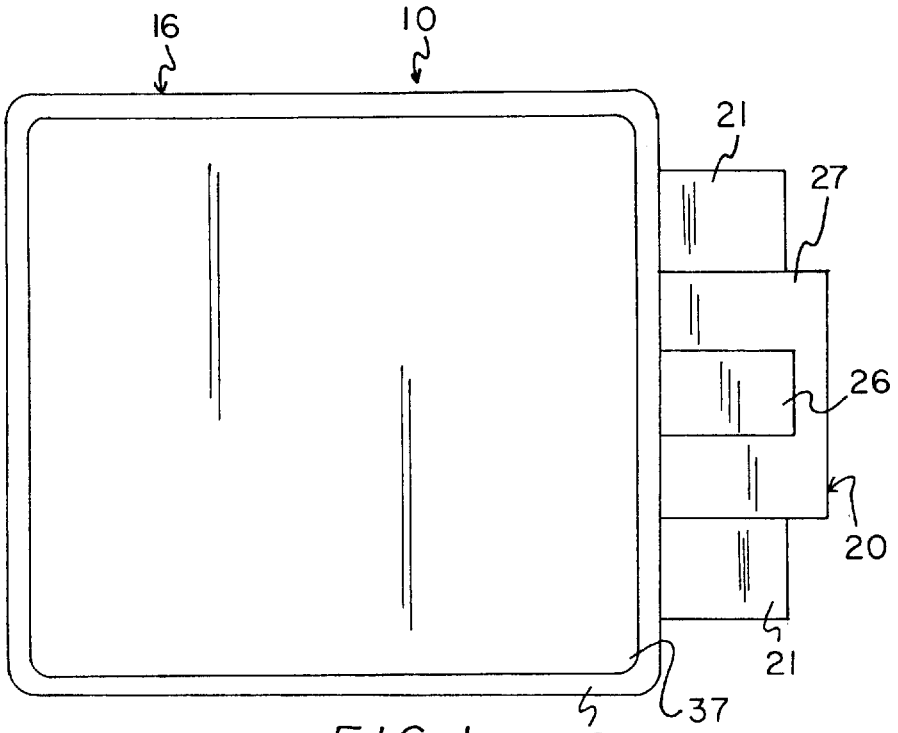
FIG. 1 is a top view of a new mouse pad support pedestal according to the present invention.
Figure 2:
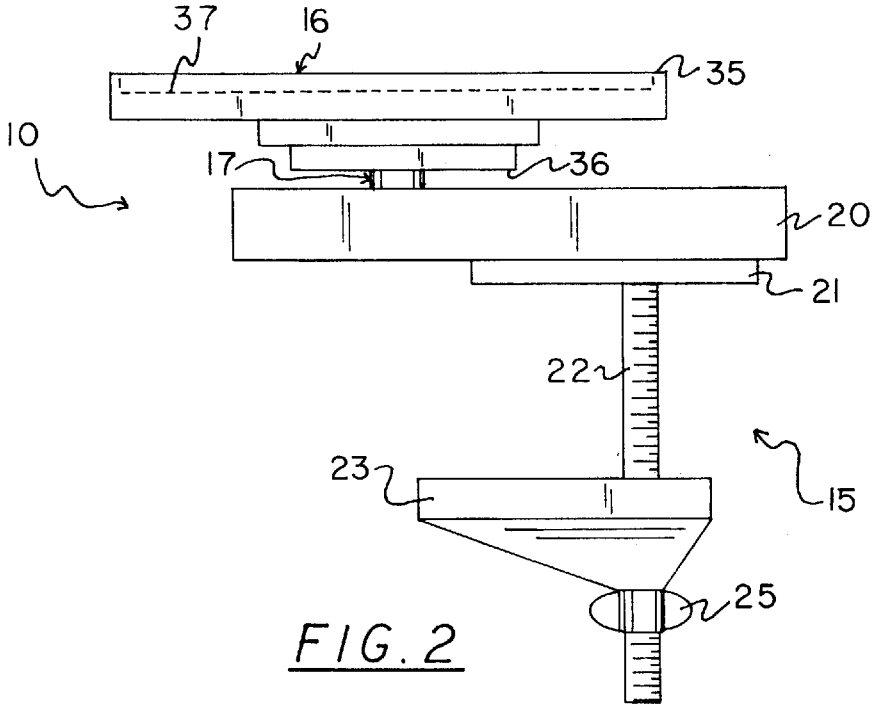
FIG. 2 a side view thereof.
Figure 3:
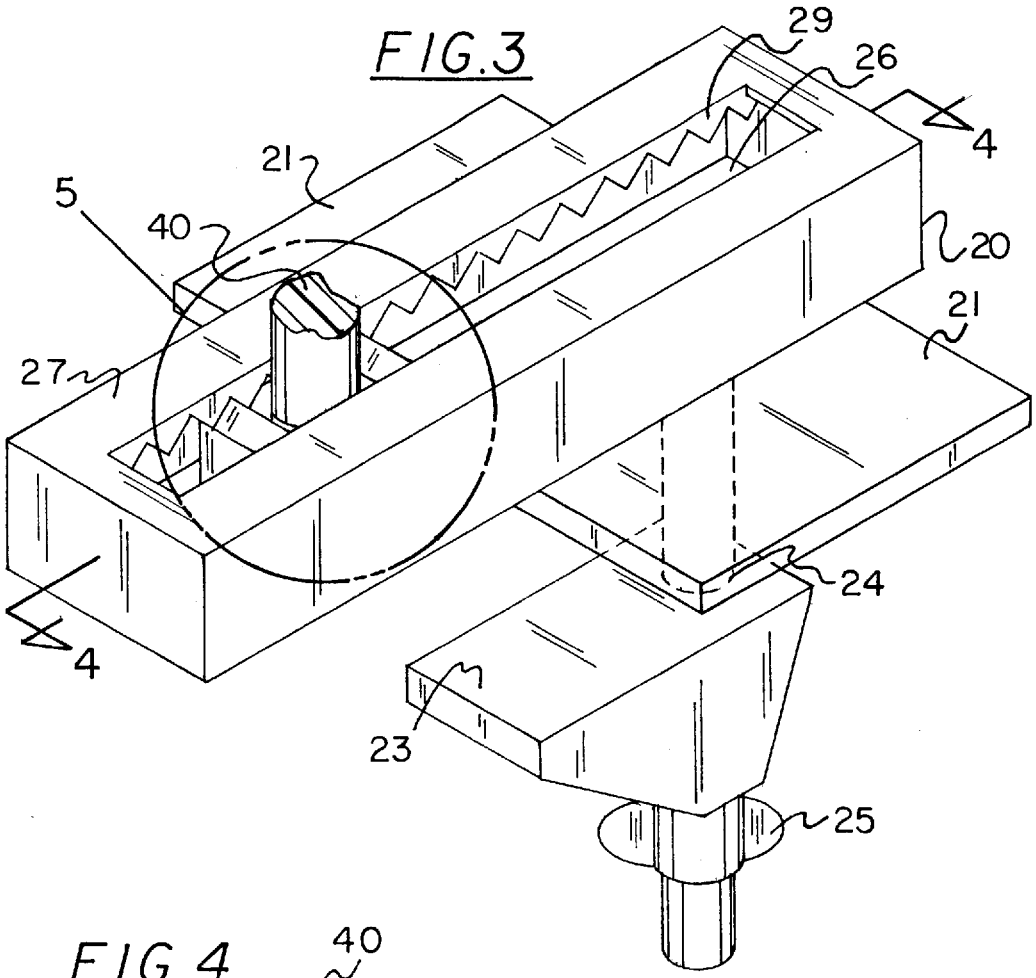
FIG. 3 a perspective view of the clamp device.
Figure 4:
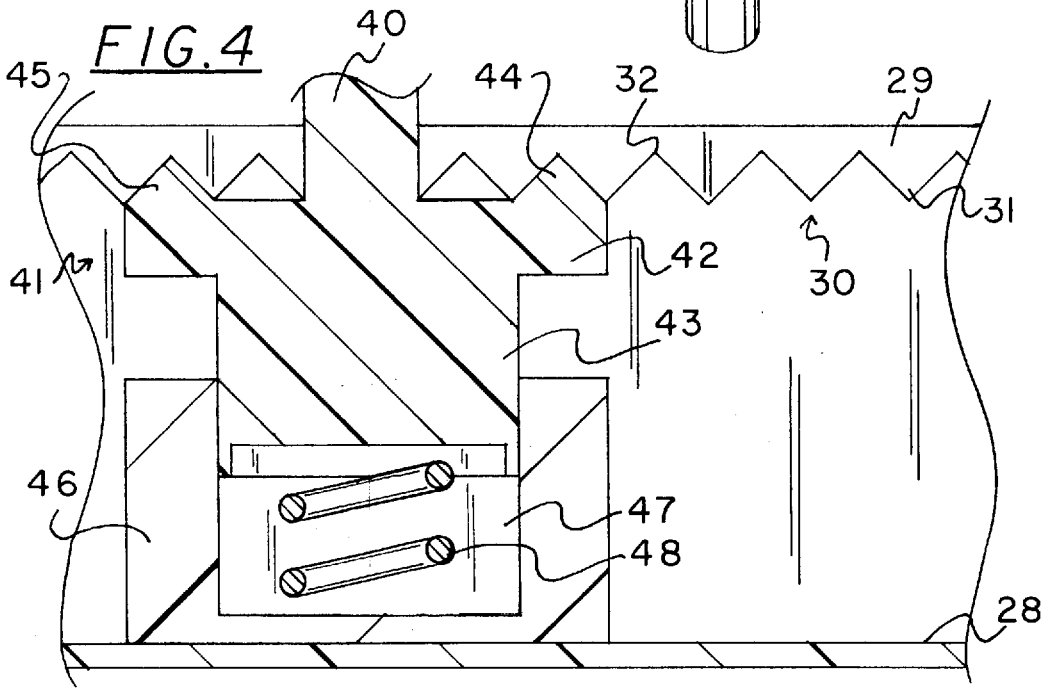
FIG. 4 is a cross sectional view taken along line 4—4 of FIG. 3.
Figure 5:
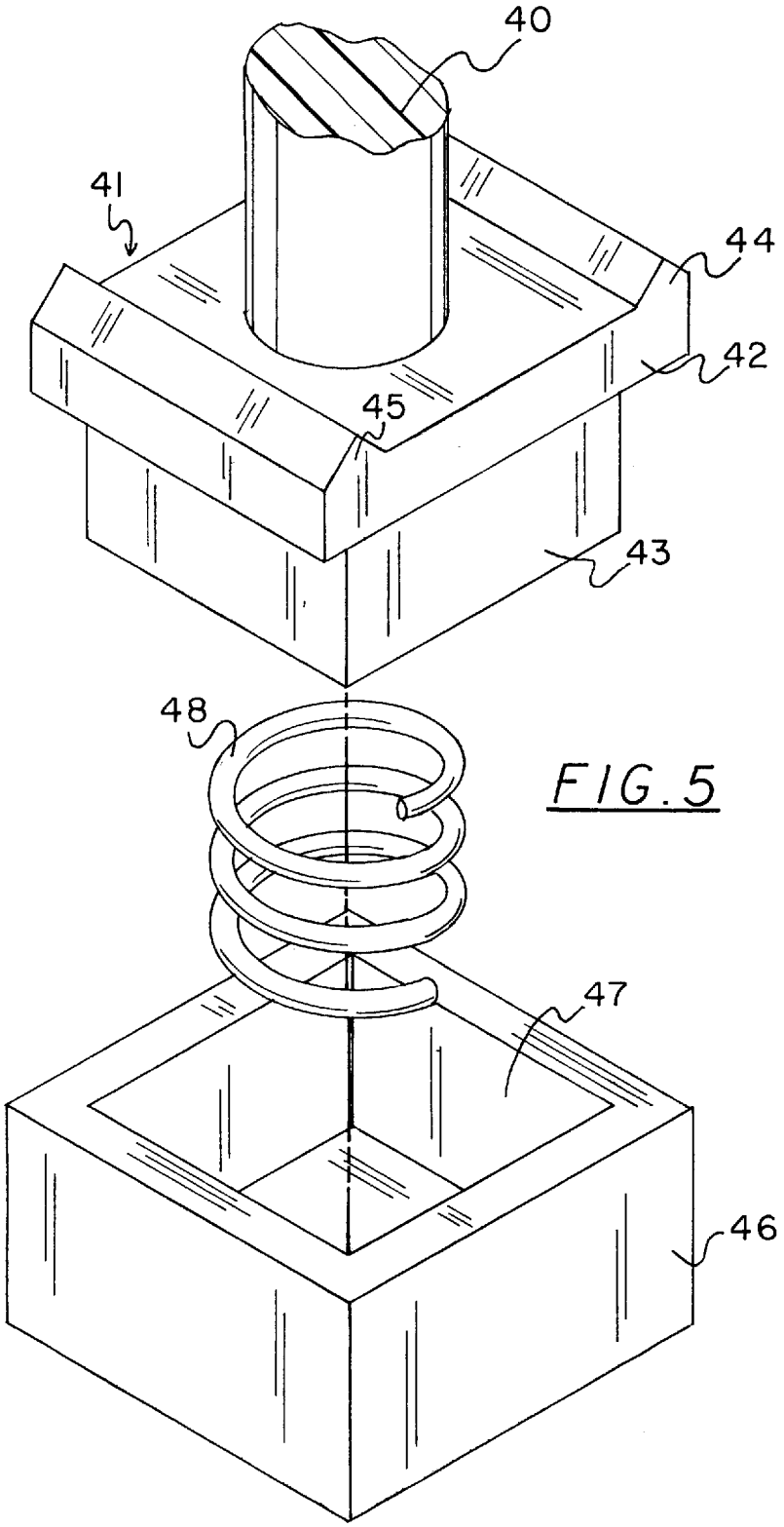
FIG. 5 is an exploded view of the attachment means contained within line 5—5 of FIG. 3.

With reference now to the drawings, and in particular to FIGS. 1 through 5 thereof, a new mouse pad support pedestal embodying the principles and concepts of the present invention and generally designated by the reference numeral 10 will be described.

More specifically, it will be noted that the mouse pad support pedestal 10 comprises a clamp device 15 and a support pedestal 16 attached to the clamp device 15 by attachment means 17.

As best illustrated in FIGS. 1 through 5, it can be shown that the clamp device 15 comprises a stationary clamping portion 20. The stationary clamping portion 20 has a generally elongated, rectangular shape. A plate 21 is attached to the bottom of the portion 20 and extends out from each side of the portion, for a purpose which will be apparent later. Instead of a single plate 21 attached to the bottom of the portion 20, separate plates could be used instead. Additionally, the portion 20 could be integrally formed with portions extending from its sides, in place of the plate 21.

A threaded rod 22 extends from the bottom of the stationary portion 20, through the plate 21. Moveable clamping portion 23 is freely disposed about the threaded rod 22. The moveable portion 23 includes a hole 24 therein which freely allows passage of the shaft 22. Wing nut 25 is threaded onto the rod 22 and disposed beneath the moveable portion 23 to move the portion 23 along the rod 22 to clamp an arm of a chair between the portions 20,23. The portion 23 is preferably rotated 90 degrees in either direction from the position shown in FIGS. 2 and 3 such that the arm of the chair is clamped between the portion 23 and the portion of the plate 21 which extends from the side of the portion 20. This permits the support pedestal, which is described later, to be adjusted in a direction approximately parallel to the arm of the chair. However, the portion 23 could be utilized in the position shown in FIGS. 2 and 3 such that the arm is clamped between the portion 23 and the portion 20 and the support pedestal can be adjusted in a direction approximately parallel to the arm. The portion 23 could also be rotated to a position anywhere in between the above described positions, to permit clamping of the apparatus to many different arms and permitting adjustment of the support pedestal at many different angles relative to the arm.

Groove 26 is formed in the upper surface 27 of the stationary clamping portion 20. The groove 26 extends longitudinally along the portion 20, over most of its length. The groove 26 includes a bottom surface 28 and the longitudinal sides of the groove are undercut to form overhanging shoulders 29 on each side which overhang the bottom surface 28. The bottom surfaces of the shoulders 29 which face the bottom surface 28 are provided with teeth 30 defining a series of peaks 31 and recesses 32.

The support pedestal 16 is disposed above the stationary clamping portion 20. As shown, the pedestal 16 is generally rectangular and includes an upper surface 35 and a lower surface 36. The upper surface 35 includes a recessed region 37 which has a length, width, and depth of sufficient dimensions to receive and retain a mouse pad therein.

Extending from the lower surface 36 of the pedestal 16 is the attachment means 17. The attachment means comprises a support shaft 40 extending from the lower surface 36, with an enlarged head portion 41 affixed at the end of the shaft 40. The enlarged head portion 41 is disposed within the groove 26 and includes a large, generally square top portion 42 and a smaller, square bottom portion 43 extending from the top portion 42. The top portion 42 includes a pair of triangular projections 44,45 at opposite ends of the portion 42 and extending upward from the top surface thereof. The projections 44,45 are sized and shaped to fit within selected ones of the recesses 32. A square slide member 46 is disposed within the groove 26 for sliding movement along the bottom surface 28. The member 46 includes a square hole 47 which slidably receives the bottom portion 43 of the enlarged head 41. Spring 48 is disposed in the hole 47 between the bottom of the slide member and the bottom of the portion 43 to bias the enlarged head upward and away from the bottom of the groove 26, so as to force the projections 44,45 into corresponding recesses 32 of the teeth 30.

Thus it should be apparent that the support pedestal can be adjusted along the stationary clamping portion by pushing the pedestal inward against the biasing force of the spring, which disengages the projections from the recesses of the teeth. The pedestal can then be manually slid either forward or backward in the slot, facilitated by the slide member 46. When the desired position is reached, the downward force on the pedestal is released, and subsequently the spring biases the enlarged head upward such that the projections disposed within the recesses, thus preventing further sliding movement of the pedestal.

In use, the user mounts the pedestal to either arm of a chair, or the like. Preferably the pedestal is mounted such that it is adjusted along the groove in a direction which is approximately parallel to the arms of the chair, i.e. the groove 26 is parallel to the arms. For instance, if mounting to the right arm of a chair, the moveable clamping portion 23 is rotated 90 degrees counterclockwise from the position shown in FIG. 3. The right arm of the chair is then disposed between the moveable portion 23 and the plate 21, and the wing nut 25 is then tightened to clamp the pedestal to the arm of the chair. The groove 26 is thus approximately parallel to the arm. The pedestal 16 can thus be moved toward or away from the user sitting in the chair, to a comfortable position determined by the user, by sliding the pedestal within the channel in the manner described above. As stated previously, the pedestal could be mounted for movement approximately perpendicular to the arm, i.e. left or right movements relative to the user, or any angle in between parallel and perpendicular.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable mouse pad support apparatus for attachment to an arm of a chair, comprising:

a clamp means for clamping the apparatus to the arm of the chair;

said clamp means including a moveable clamping portion and a stationary clamping portion;

a support pedestal having an upper surface and a lower surface; the upper surface adapted to support a mouse pad thereon; and adjustable attachment means for adjustably attaching the support pedestal to the stationary clamping portion such that the support pedestal can be adjusted along the stationary clamping portion;

wherein the stationary clamping portion includes a longitudinal groove formed in an upper surface thereof, said adjustable attachment means comprises a shaft extending from the lower surface of the support pedestal and an enlarged head portion attached to an end of the shaft and disposed within the groove;

wherein a bottom of the enlarged head portion is disposed within a slide member located at a bottom of the groove; and a spring is disposed between the slide member and the bottom of the enlarged head portion.

2. The adjustable mouse pad support apparatus of claim 1, wherein the support pedestal upper surface includes a dished portion sized to retain the mouse pad therein.

3. The adjustable mouse pad support apparatus of claim 1, wherein the spring is adapted to bias the enlarged head portion away from the slide member.

4. The adjustable mouse pad support apparatus of claim 3, wherein the enlarged head portion includes projections thereon which are selectively disposed within correspondingly shaped recesses formed in the groove.

5. The adjustable mouse pad support apparatus of claim 1, wherein the support pedestal is adjustable along the stationary clamping portion so that the support pedestal can be oriented in a direction approximately parallel to an arm of a chair.

6. A support apparatus for a mouse pad for attachment to an arm of a chair comprising:

a clamp device for clamping the apparatus to the arm of the chair;

said clamp device including a moveable clamping portion and a stationary clamping portion adapted to clamp the arm therebetween;

a support pedestal having an upper surface and a lower surface; said upper surface including a recessed region sized to retain the mouse pad therein;

attachment means extending from the lower surface for attaching the support pedestal to the stationary clamping portion; and said attachment means permitting adjustment of the support pedestal longitudinally along the stationary clamping portion;

wherein the stationary clamping portion includes:

a longitudinal groove formed in an upper surface thereof;

said attachment means comprises a shaft extending from the lower surface of the support pedestal and an enlarged head portion attached to an end of the shaft and disposed within the groove;

wherein a bottom of the enlarged head portion is disposed within a slide member adapted for sliding movement along a bottom of the groove;

and a spring is disposed between the slide member and the bottom of the enlarged head portion.

7. The support apparatus of claim 6, wherein the spring is adapted to bias the enlarged head portion away from the slide member.

8. The support apparatus of claim 6, wherein the enlarged head portion includes projections thereon which are selectively disposed within correspondingly shaped recesses formed along the groove.

9. The adjustable mouse pad support apparatus of claim 6 wherein the support pedestal is adjustable along the stationary clamping portion so that the support pedestal can be oriented in a direction approximately parallel to an arm of a chair.

* * * * *